United States Patent [19]

Geschwender

[11] 4,333,602

[45] Jun. 8, 1982

[54] RECLOSABLE CONTAINER

[75] Inventor: Robert C. Geschwender, Lincoln, Nebr.

[73] Assignee: Concept Engineering Inc., Lincoln, Nebr.

[21] Appl. No.: 210,284

[22] Filed: Nov. 26, 1980

[51] Int. Cl.[3] ..... B65D 5/66

[52] U.S. Cl. ..... 229/44 R; 206/631; 229/45 R

[58] Field of Search ..... 206/631, 633, 813; 229/44 R, 45 R, 78 R, 78 A, 78 B

[56] References Cited

U.S. PATENT DOCUMENTS

| | | | |
|---|---|---|---|
| 943,205 | 12/1909 | Wachtermann | 229/78 B |
| 1,112,486 | 10/1914 | Spring | 229/78 B |
| 1,209,109 | 12/1916 | Bossart | 229/78 B |
| 2,099,166 | 11/1937 | Inman et al. | 206/633 |
| 2,113,927 | 4/1938 | Alfred | 206/631 |
| 2,187,305 | 1/1940 | Farmer | 206/631 |
| 2,317,773 | 4/1943 | Kavanaugh | 206/631 |
| 2,360,117 | 10/1944 | Fellowes | 229/44 R |
| 2,865,549 | 12/1958 | Inman | 229/16 |
| 2,870,950 | 1/1959 | Inman | 229/16 |
| 3,306,521 | 2/1967 | Giacovas | 229/45 R |
| 3,325,084 | 6/1967 | Ausnit | 229/45 R |
| 3,550,837 | 12/1970 | Erb | 229/45 R |
| 3,813,017 | 5/1974 | Pimsleur | 224/26 |

FOREIGN PATENT DOCUMENTS

| | | | |
|---|---|---|---|
| 1359799 | 3/1964 | France | 229/45 R |

*Primary Examiner*—Stephen P. Garbe

*Attorney, Agent, or Firm*—Senniger, Powers, Leavitt and Roedel

[57] ABSTRACT

A reclosable container of substantially rigid material has a rectangular opening providing access to the interior of the container and a rectangular lid hinged at one side of the opening. A planar corner flap portion of the lid, defined by a hinge line extending generally diagonally with respect to the lid, swings from a first position overlying a substantially rigid planar portion of the container, such as an interior front flap hinged at the side of the opening opposite the lid, to a second position away from the front flap. A two-part fastener releasably secures the flap portion of the lid to the front flap of the container to maintain the lid closed, the fastener having a first part secured to the front flap and a second part to the corner flap closely adjacent the aforesaid hinge line. The corner flap extends outwardly beyond the second fastener part, with the outer portion serving as a lever for swinging the corner flap from its first position in which the fastener parts are interengaged for maintaining the lid closed to its second position in which the fastener parts are disengaged for permitting the lid to be opened, the container being reclosable by swinging the corner flap back to its first position.

4 Claims, 6 Drawing Figures

RECLOSABLE CONTAINER

BACKGROUND OF THE INVENTION

The present invention relates generally to container constructions, and more specifically to reclosable cartons of the type having a lid which may be releasably secured in closed position.

In the prior art, cartons of substantially rigid material such as corrugated boxboard have been made reclosable, that is, their lids made to be repeatedly opened and closed. Their lids have been secured in closed position by wrapping the carton with twine or by an integrally-provided fastener, such as a flap tucked into a retaining slot or twine wound around buttons on two side-by-side lid flaps. Such fastening systems add to the cost of manufacturing and detract from the appearance of the carton.

Use of two-part fasteners of the type sold under the registered trademark "Velcro" by Velcro Corp., 681 Fifth Avenue, New York, N.Y. 60022 to fasten the lids of corrugated boxboard cartons was first thought to be generally impractical because the relatively large force required to separate the two "Velcro" patches, each adhesively secured to this substantially rigid material, tended to cause the patches to pull off the material before the patches themselves separated. This makes the lid difficult to open, and prevents reclosure.

Reference may be made to U.S. Pat. Nos. 2,865,549, 2,870,950, and 3,813,017 for containers generally in the field of the invention.

SUMMARY OF THE INVENTION

Among the several objects of the present invention may be noted the provision of an improved reclosable container or carton of rigid material, such as corrugated boxboard, designed for easy opening and firm closing; the provision of such a carton having lid fasteners which are durable in use; and the provision of such a carton wherein the lid fasteners are hidden from view when the lid is closed for enhancing the appearance of the carton.

Briefly summarized, the reclosable container of the present invention has an opening providing access to its interior and a lid for the opening with at least a portion of the lid being substantially rigid and planar and hinged for swinging about a hinge line from a first position overlying a substantially rigid planar portion of the container to a second position away from the container portion. A two-part fastener, for releasably securing the lid portion to the container portion to maintain the lid closed, has a first part which is secured to the container portion and a second part secured to the lid portion closely adjacent its hinge line. The lid portion extends outwardly beyond the second fastener part to serve as a lever for swinging the lid portion from its first position in which the fastener parts are interengaged for maintaining the lid closed to its second position in which the fastener parts are disengaged for permitting the lid to be opened. The container is reclosable by swinging the lid portion back to its first position. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
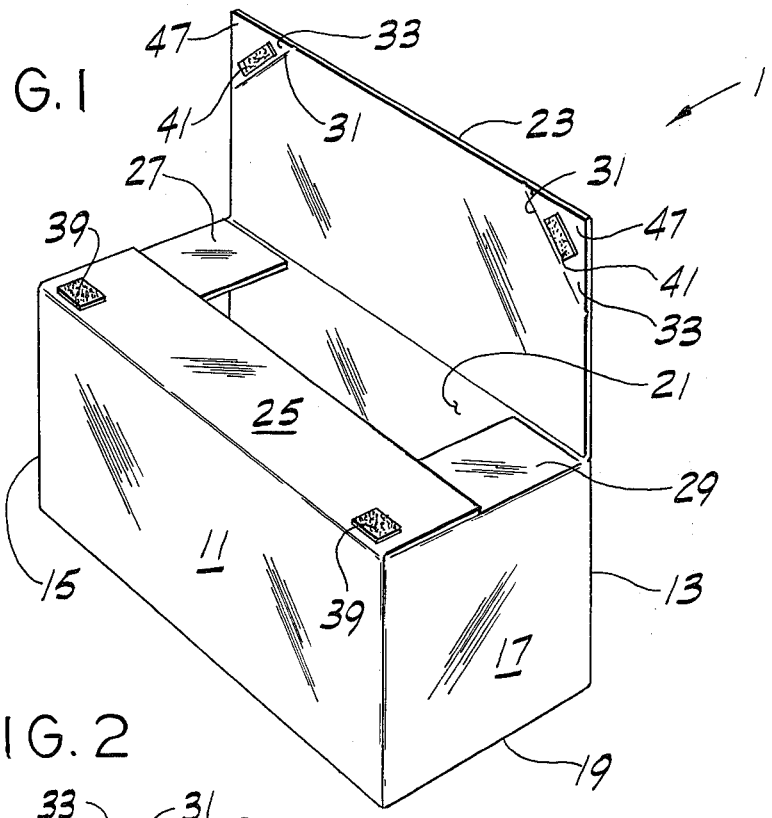
FIG. 1 is a perspective of a carton embodying the present invention, shown with its lid swung open.

Referring now to FIGS. 1–4 of the drawings, a container of the present invention is designated in its entirety by the reference numeral 1. More specifically, container 1 is a carton of substantially rigid material, such as corrugated boxboard, having a front side 11, rear side 13, left side 15, right side 17, bottom 19, and a rectangular top opening 21 providing access to the interior of the container. A rectangular lid 23 is hinged to the upper edge of the rear side 13 of the container and, when closed, closes the entire opening 21. The lid may be swung between an open position, shown in FIG. 1, and a closed position, shown in FIG. 2.

Figure 2:
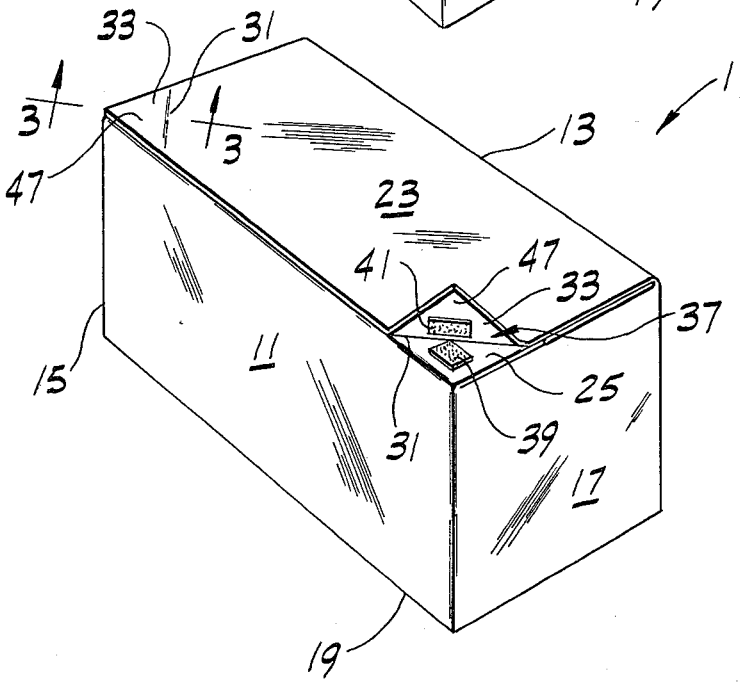
FIG. 2 is a view similar to FIG. 1, with the lid closed and one corner flap swung up to show a two-part fastener for releasably securing the lid in its closed position.

To support lid 23 in its closed position, a front interior flap 25 is hinged to the front side 11 of the carton at the front edge of the rectangular opening and extends rearwardly therefrom approximately halfway across the opening 21. Front interior flap 25 serves as a rigid planar portion of the container which supports the closed lid 23 generally horizontally, preventing it from swinging down into the interior of the container. Left and right side interior flaps 27, 29, hinged to the upper edges of the left and right sides 15, 17 of the carton, underlie the front flap 25 and support it. Each of these side flaps 27, 29 spans approximately one-fourth of the opening width. To close the carton, side flaps 27, 29 are first swung over opening 21, front interior flap 25 swung to overlie the side flaps, and lid 23 then swung down to overlie and be supported over the opening by the interior flaps 25, 27, 29, as shown in FIG. 2.

Figure 3:
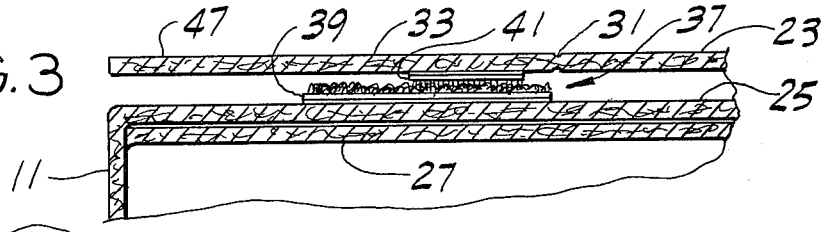
FIG. 3 is a vertical section taken along line 3—3 of FIG. 2, showing a corner flap swung down to releasably secure the lid closed.
Figure 4:
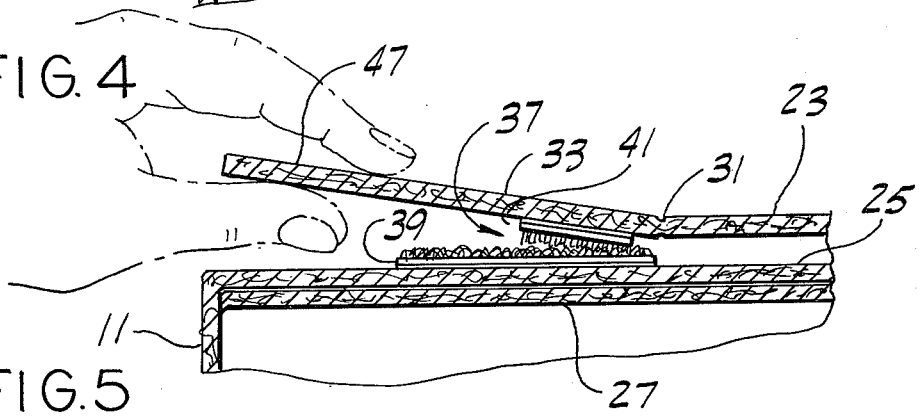
FIG. 4 is a view similar to FIG. 3 showing the gradual disengagement of the two-part fastener as the corner flap is swung open.
Figure 6:
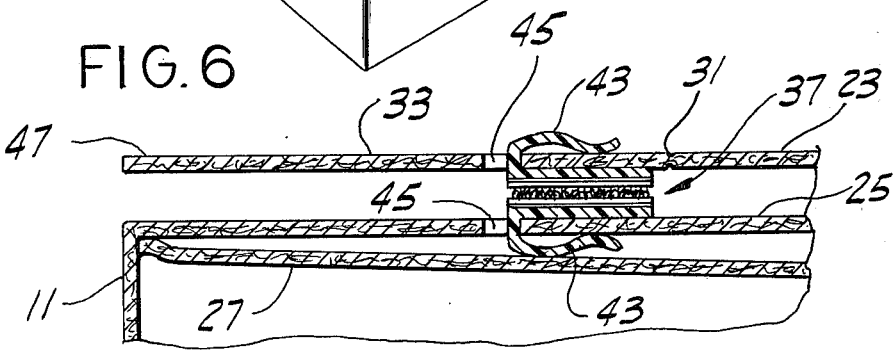
FIG. 6 is a vertical section taken along line 6—6 of FIG. 5 showing the clips in detail.

A pair of hinge lines 31 at the outer or free end of lid 23 extend generally diagonally with respect to the lid, one hinge line 31 extending between the front and right side edges of the lid and the other between the front and left side edges of the lid. Hinge lines 31 may be formed by creasing the corrugated boxboard on one side or on both sides, as shown in FIGS. 3, 4 and 6. The two hinge lines define a pair of substantially rigid and planar generally triangular corner portions or flaps 33 at the two outer corners of the lid. When the lid is closed and corner flaps 33 are swung to a first or lowered position coplanar with the lid, the corner flaps overlie and are substantially parallel to front flap 25, as shown in FIG. 3. The corner flaps may be swung upward on their hinge lines 31 as shown in FIG. 4 to a second or raised position away from the front flap.

A pair of two-part fasteners, each generally designated 37, releasably secure corner flaps 33 to front flap 25, thereby securing lid 23 in closed position. Each fastener 37 comprises a pair of rectangular interengagèable "Velcro" parts or patches designated 39 and 41. The first part 39 is secured to the exterior or upper surface of the front flap 25 adjacent a forward corner of the carton and comprises a sheet having a plurality of loop elements. The second part 41 is secured to the lower or interior side of a respective corner flap 33 closely adjacent its hinge line 31 and comprises a sheet having a plurality of resilient hook elements which engage the loop elements of part 39 when the two "Velcro" sheets are brought into facial contact with one other, that is, when lid 23 is closed and corner flap 33 is swung down to its FIG. 3 position. In the embodiment shown in FIGS. 1–4, the "Velcro" patches or parts 39, 41, are secured to the container by suitable adhesive bonding.

Each corner flap 33 extends outwardly beyond the "Velcro" patch 41 thereon and serves as a lever or lever end 47 which may be grasped for swinging the flap 33 about hinge line 31 between its lowered (FIG. 3) position in which the fastener parts 39, 41 are interengaged to secure lid 23 closed, and its raised position in which the fastener parts are disengaged for permitting the lid to be opened.

Due to the characteristics of the "Velcro" fastener hook and loop elements, some minimum separation or lost motion must be imparted to the fastener sheets before the loops and hooks disengage from each other. This lost motion characteristic is employed advantageously in the present invention by the provision of corner flaps 33 which swing angularly away from front flap 25. When a corner flap 33 is swung on its hinge line 31 away from its lowered position, as shown in FIG. 4, the two fastener sheets 39, 41 are no longer substantially parallel. Instead, the spacing between the two sheets varies in proportion to the distance from hinge line 31 (the greater the distance the greater the spacing or separation). Thus, the hook and loop elements spaced the farthest from the hinge line disengage first, with disengagement occurring generally along a line (or narrow strip) which parallels the hinge line and which advances progressively toward the hinge line as corner flap 33 is raised. It will be understood, therefore, that disengagement occurs gradually in a manner similar to the conventional peeling action of a "Velcro" fastener mounted on flexible material, even though in this use the "Velcro" fastener is mounted on the substantially inflexible corrugated boxboard. The principal advantage of gradual disengagement lies in the decreased force required to disengage only a small portion of the area of the hook and loop elements at any instant rather than all of the elements simultaneously. Reducing the force required to disengage the fastener not only makes the carton easier to open but also reduces the risk that either of the "Velcro" patches 39, 41 will be pulled from their mountings on the container.

In order to take maximum advantage of progressive separation of the hook and loop elements, fastener part 41 on each corner flap 33 is mounted closely adjacent to hinge line 31. This assures that the relative angular positions of corner flap 33 and front flap 25, as the corner flap is swung upwardly, provides the greatest possible differential in spacing between the inner (right as viewed in FIGS. 3 and 4) and outer (left) edges of fastener sheets 39, 41. This is important in that the greater the spacing differential, the smaller the area over which disengagement occurs at any given instant and the lesser the force tending to separate the fastener from the container.

To further minimize the force of separation, the patch 41 on each corner flap 33 is relatively small, having an area which is preferably less than the remaining area of the corner flap which is free of any fastener elements. The corner flaps are thereby disengageable from front flap 25 by swinging the corner flap with a force that does not exceed that force which would cause a patch 39, 41 to tear away from that portion of the container or lid to which it is secured or cause the corrugated boxboard corner flap 33 to bend.

To close carton 1, side flaps 27, 29 are swung over the opening 21, front flap 25 is swung over the opening 21 overlying side flaps 27, 29, and lid 23 is swung over opening 21 overlying all of the interior flaps 25, 27, 29. The lid may then be secured in its closed position by pressing corner flaps 33 downward against front flap 25 to bring the "Velcro" patches 39 and 41 into engagement with one another. To reopen the lid, the corner flaps 33 are grasped by their lever ends 47 and pulled upward, causing the flaps to swing about their hinge lines 31 to disengage the patches 39 and 41 from one another. After they are disengaged, lid 23 and interior flaps 25, 27, 29 may be swung open for access to the interior of the container.

Figure 5:
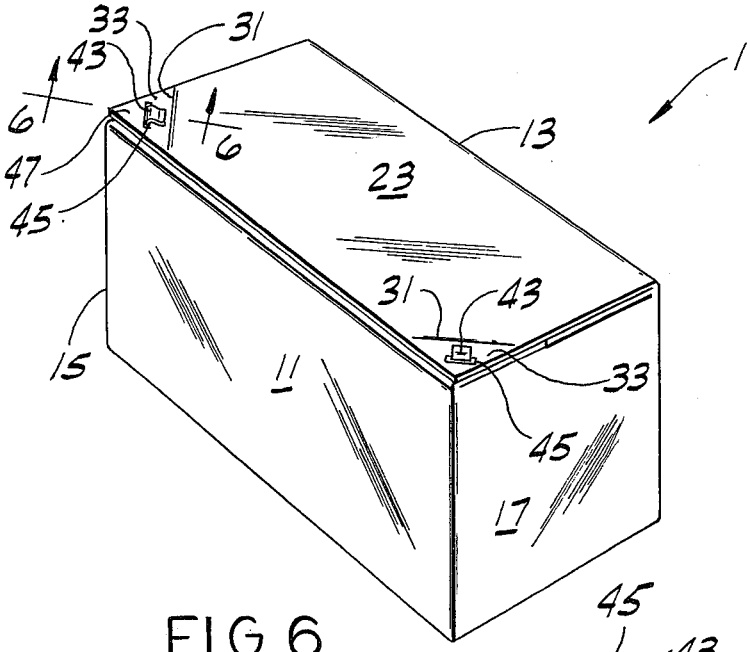
FIG. 5 shows an alternative embodiment in which the fasteners are secured to the carton by U-shaped spring clips.

The carton shown in FIGS. 5 and 6 is identical to carton 1 described above (with corresponding parts being identified by the same reference numerals) except that the "Velcro" patches 39, 41 are secured to corner flaps 33 and front flap 25 by generally U-shaped spring clips 43 fixed to the back faces of the patches, that is, the sides opposite the loop or hook elements. The clips 43 are receivable in slot openings 45 in corner flaps 33 and front flap 25 for clipping fastener parts 39, 41 in position. Clip mounting of fastener parts 39, 41 to the container provides an alternative where adhesive bonding may not be appropriate, such as where extra securing strength is required.

It will be understood that fasteners other than those of the "Velcro" type may also be used (e.g., snap fasteners and magnetic fasteners).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A container having an opening providing access to the interior thereof, a lid for the opening, at least a portion of said lid being substantially rigid and planar and hinged for swinging about a hinge line from a first position overlying a substantially rigid planar portion of the container to a second position away from said container portion, and a two-part fastener for releasably securing said lid portion to said container portion thereby to maintain the lid closed, the first part of said fastener being secured to said container portion and the second part to said lid portion closely adjacent said hinge line with the lid portion extending outwardly beyond said second part and serving as a lever for swinging said lid portion from said first position in which said fastener parts are interengaged for maintaining the lid closed to said second position in which said fastener parts are disengaged for permitting the lid to be opened, said container being recloseable by swinging the lid portion back to said first position, said fastener parts being secured to said lid and container portions by clips receivable in openings in the lid and container portions for clipping said fastener parts in position.

2. The container defined in claim 1 wherein said clips are generally U-shaped spring clips.

3. A container having a generally rectangular opening providing access to the interior thereof, a generally rectangular lid for the opening hinged at one edge of the opening, at least a portion of said lid being substantially rigid and planar and hinged for swinging about a hinge line from a first position overlying a substantially rigid planar portion of the container to a second position away from said container portion, and a two-part fastener for releasably securing said lid portion to said container portion thereby to maintain the lid closed, the first part of said fastener being secured to said container portion and the second part to said lid portion closely adjacent said hinge line with the lid portion extending outwardly beyond said second part and serving as a lever for swinging said lid portion from said first position in which said fastener parts are interengaged for maintaining the lid closed to said second position in which said fastener parts are disengaged for permitting the lid to be opened, said container being recloseable by swinging the lid portion back to said first position, said lid portion comprising a corner portion at the outer end of the lid with its hinge line extending generally diagonally with respect to the lid.

4. The container defined in claim 3 wherein said rigid planar portion of the container comprises an interior flap hinged to the carton at the edge of the rectangular opening opposite the edge at which the lid is hinged.

* * * * *